United States Patent [19]

Tedder et al.

[11] 4,140,062

[45] Feb. 20, 1979

[54] DIFFERENTIAL INTEGRATOR

[75] Inventors: Paul M Tedder, Gainesville; Ovid R. Gano, Melrose, both of Fla.

[73] Assignee: The United States of America as represented by the Secretary of the Army, Washington, D.C.

[21] Appl. No.: 488,736

[22] Filed: Feb. 16, 1955

[51] Int. Cl.[2] ..... F42C 11/00

[52] U.S. Cl. ..... 102/219

[58] Field of Search ..... 250/27, 31, 21, 20, 250/531; 102/219, 70.2

[56] References Cited

U.S. PATENT DOCUMENTS 2,453,958 11/1948 Andresen ..... 250/27 PSS

OTHER PUBLICATIONS

"Radar Circuit Analysis" Air Force Manual 52-8, pp. 8-5, and 6-8.

*Primary Examiner*—Charles T. Jordan

*Attorney, Agent, or Firm*—Nathan Edelberg; Robert P. Gibson; Saul Elbaum

[57] EXEMPLARY CLAIM

1. A differential integrator circuit comprising: an input capacitance; means for applying an a-c input signal of varying amplitude between one terminal of said capacitance and circuit ground; first and second resistances each having one terminal connected to circuit ground; first and second capacitances connected across said first and second resistances respectively, said second capacitance being larger than said first capacitance; first and second diodes connected between the other terminal of said input capacitance and the ungrounded terminals of said first and second resistances respectively, said diodes being connected with opposite polarities; means for taking a first unipotential ouput signal from across said first resistance; and means for taking a second unipotential output signal from across said second resistance.

6 Claims, 4 Drawing Figures

INVENTORS
Paul M. Tedder
Ovid R. Gano
W. E. Thibodeau, A. W. Dew and J. J. Edgerton
BY
ATTORNEYS

DIFFERENTIAL INTEGRATOR

This invention relates to an electronic circuit which demodulates an applied alternating-current signal of varying amplitude and provides two useful output voltages simultaneously: a first output voltage that includes a component corresponding to the differentiated signal envelope, and a second output voltage consisting of the integrated signal envelope. Either one of these output voltages can be used alone, they can be used separately, or they may be combined through additional networks to produce various desired effects.

The principal object of the present invention is to provide a practical, economical, electronic circuit, requiring few components, that will simultaneously provide (1) an output voltage having a component corresponding to the differentiated envelope of an applied alternating current signal of varying amplitude, and (2) an output voltage consisting of the integrated envelope of the applied signal.

A further object is to provide an electronic ordnance fuze responsive to signals of certain amplitude and rise-rate characteristics, the sensitivity of such fuze to be automatically reduced in the presence of sustained signals of substantial amplitude.

Other objects, aspects, uses, and advantages of the invention will become apparent from the following description and from the accompanying drawing, in which —

Figure 1:
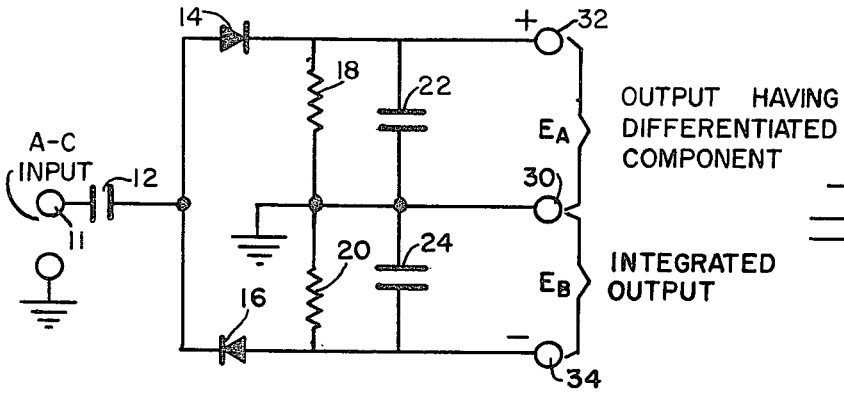
FIG. 1 is a circuit diagram of a basic form of my differential integrator circuit.

In FIG. 1, an alternating current input signal of varying amplitude is applied between an input terminal 11 and ground. After passing through a capacitance 12 the input signal is detected by diodes 14 and 16 having load resistances 18 and 20 respectively. Diodes 14 and 16 are connected with opposite polarity. Resistances 18 and 20 are shunted by capacitances 22 and 24 respectively. Resistance 20 is preferably greater than resistor 18 and capacitance 24 must be greater than capacitance 22; in the embodiments that I have found most useful, resistance 20 is much greater than resistance 18, capacitance 24 is much greater than capacitance 22, and the time constant of the combination of resistance 20 and capacitance 24 is much greater than the time constant of the combination of resistance 18 and capacitance 22. A first output voltage $E_A$ is taken from across resistance 18, and a second output voltage $E_B$ — of opposite polarity — is taken from across resistance 20. It should be noted that if either resistance 18 or resistance 20 were short circuited, diodes 14 and 16 and capacitance 12 would constitute a half-wave voltage doubler which would build up a unipotential voltage approximately equal to the peak-to-peak value of the signal voltage across the remaining resistance-capacitance combination.

For an a-c input signal of constant amplitude, it will be understood that the total d-c voltage output between terminals 32 and 34 will divide according to the ratio of the two resistances 18 and 20. Suppose now that there is an abrupt step change in the amplitude of the a-c input signal. A quasi-instantaneous change in total output voltage $E_A + E_B$ results, and this quasi-instantaneous change is divided between $E_A$ and $E_B$ in inverse proportion to the values of capacitances 22 and 24. After a time determined largely by the time constant of the circuit, however, the total output voltage redistributes so that it is again divided according to the ratio of the two resistances 18 and 20. It will be understood that $E_A$, because it contains a component due to the rate of change of the a-c input signal, may be referred to as a "differentiated output" voltage. It will also be understood that $E_B$, which responds relatively slowly to changes in a-c input signal, may appropriately be called an "integrated output" voltage. The polarities of $E_A$ and $E_B$ can be reversed by reversing the polarities of diodes 14 and 16.

Figure 2:
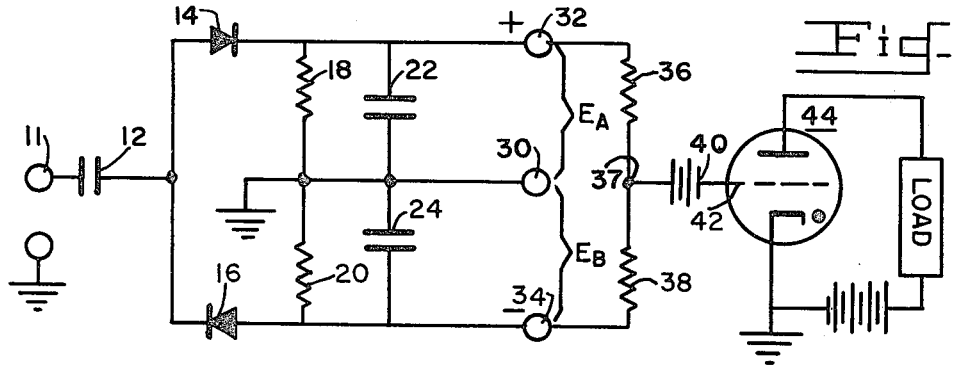
FIG. 2 is a circuit diagram of an arrangement in which the two outputs of my differential integrator are combined to cause firing of a thyratron when their ratio attains a predetermined value.

In FIG. 2, a voltage divider consisting of resistances 36 and 38 in series is connected between output terminals 32 and 34. Junction 37 of resistors 36 and 38 is connected through a grid bias source 40 to the grid 42 of a thyratron 44. The potential of bias source 40 is so selected that thyratron 44 will fire when the potential at junction 37 reaches a predetermined value slightly above ground potential. The ratio of resistance 36 to resistance 38 is greater than the ratio of resistance 18 to resistance 20. This means that a steady a-c input signal at terminal 11 will cause the potential at junction 37 to go negative; it will be understood that thyratron 44 will fire only if an a-c input signal having a sufficient rise rate causes the ratio of $E_A$ to $E_B$ to exceed the ratio of resistance 36 to resistance 38.

Figure 3:
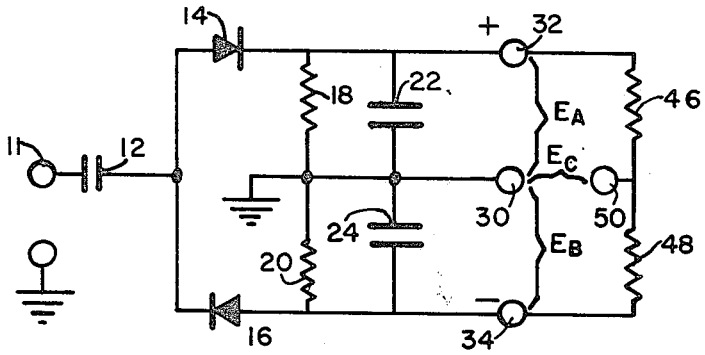
FIG. 3 is a diagram of a variation of my differential integrator in which a third output voltage is provided, this third output voltage being solely due to differentiation of the applied a-c signal and being without any residual voltage.

In FIG. 3, resistances 46 and 48 having the same ratio as resistances 18 and 20 are connected across output terminals 32 and 34. The junction of resistances 46 and 48 is connected to an additional output terminal 50. With this arrangement a third output voltage $E_C$ can be taken from between terminal 50 and circuit ground. It will be understood that $E_C$ will be zero for steady a-c input signals but will go positive or negative as the a-c input rises or falls. $E_C$ is thus a differentiated output voltage which, unlike $E_A$, has no residual steady-state component.

Figure 4:
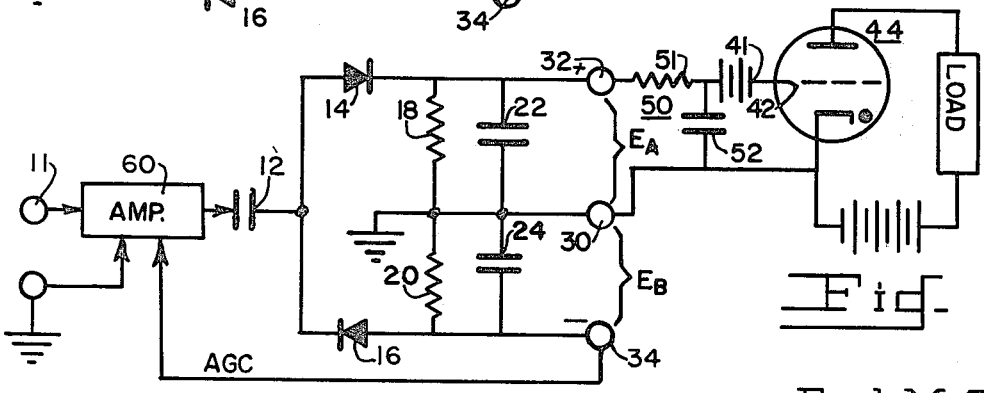
FIG. 4 is a diagram of an embodiment of my invention that is particularly applicable to electronic ordnance fuzes.

In FIG. 4, an amplifier 60 is interposed between input terminal 11 and capacitance 12. Output voltage $E_A$ is applied through integrator 50 comprising resistor 51 and capacitor 52, and through bias source 41, to grid 42 of thyratron 44. Thyratron 44 fires when output voltage $E_A$ attains a sufficient value for a sufficient time to raise the output integrator 50 to a predetermined value. Output voltage $E_B$, which is negative, is applied to amplifier 60 as an automatic gain control voltage. Large signals of appreciable duration thus reduce the gain of amplifier 60, so that a rapid increase in the amplitude of the input signal will not cause $E_A$ to reach as large a value as would otherwise be the case; thyratron 44 is thus effectively desensitized in the continued presence of steady signals. In this application resistance 20 and capacitance 24 are both preferably much larger than resistance 18 and capacitance 22 respectively.

It will be apparent that the embodiments shown are only exemplary and that various modifications can be made in construction and arrangement within the scope of the invention as defined in the appended claims.

We claim:

1. A differential integrator circuit comprising: an input capacitance; means for applying an a-c input signal of varying amplitude between one terminal of said capacitance and circuit ground; first and second resistances each having one terminal connected to circuit ground; first and second capacitances connected across said first and second resistances respectively, said second capacitance being larger than said first capacitance; first and second diodes connected between the other terminal of said input capacitance and the ungrounded terminals of said first and second resistances respectively, said diodes being connected with opposite polarities; means for taking a first unipotential output signal from across said first resistance; and means for taking a second unipotential output signal from across said second resistance.

2. The invention in accordance with claim 1 wherein said second resistance is very much greater than said first resistance and said second capacitance is very much greater than said first capacitance.

3. The invention in accordance with claim 2, there being additionally provided: a voltage divider consisting of third and fourth resistances connected in series across the ungrounded terminals of said first and second resistances respectively, the ratio of said third resistance to said fourth resistance being the same as the ratio of said first resistance to said second resistance; and means for taking a third output signal from across the junction of said third and fourth resistances and circuit ground.

4. A differential integrator and thyratron circuit comprising: an input capacitance; means for applying an a-c input signal of varying amplitude between one terminal of said capacitance and circuit ground; first and second resistances each having one terminal connected to circuit ground, said second resistance being very much larger than said first resistance; first and second capacitances connected across said first and second resistances respectively, said second capacitance being very much larger than said first capacitance; first and second diodes connected between the other terminal of said input capacitance and the ungrounded terminals of said first and second resistances respectively, said diodes being connected with opposite polarities; a voltage divider consisting of third and fourth resistances connected in series across the ungrounded terminals of said first and second resistances respectively, the ratio of said third resistance to said fourth resistance being greater than the ratio of said first resistance to said second resistance; and a thyratron having its grid connected to the junction of said third and fourth resistances through a grid bias source, said thyratron firing when the potential at said junction reaches a predetermined value above ground potential.

5. In an electronic ordnance fuze, a circuit comprising: an input terminal adapted to receive an alternating current signal of increasing amplitude; an amplifier having its input connected to said input terminal; an input capacitance having one terminal connected to the output of said amplifier; a first diode having its anode connected to the other terminal of said capacitance; a first resistance connected between the cathode of said first diode and circuit ground; a first capacitance connected across said first resistance; a second diode having its cathode connected to said other terminal of said input capacitance; a second resistance connected between the anode of said second diode and circuit ground, said second resistance being larger than said first resistance; a second capacitance connected across said second resistance, said second capacitance being larger than said first capacitance; means for utilizing the positive-going unipotential signal at the cathode of said first diode to fire a thyratron; and means for connecting the negative-going unipotential signal at the anode of said second diode to an electrode of said amplifier, said negative-going signal tending to reduce the gain of the amplifier.

6. The invention in accordance with claim 5 wherein said second resistance is very much larger than said first resistance and said second capacitance is very much larger than said first capacitance.

* * * * *